US008641431B2

(12) United States Patent
Blasick

(10) Patent No.: US 8,641,431 B2
(45) Date of Patent: Feb. 4, 2014

(54) COAXIAL CABLE CONNECTOR

(75) Inventor: Francis John Blasick, Halifax, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 68 days.

(21) Appl. No.: 13/399,636

(22) Filed: Feb. 17, 2012

(65) Prior Publication Data

US 2013/0217258 A1 Aug. 22, 2013

(51) Int. Cl.
*H01R 4/38* (2006.01)

(52) U.S. Cl.
USPC ..... 439/99; 439/578

(58) Field of Classification Search
USPC ..... 439/99, 578, 394
See application file for complete search history.

(56) References Cited

U.S. PATENT DOCUMENTS

| | | | | | |
|---|---|---|---|---|---|
| 3,646,502 | A * | 2/1972 | Hutter et al. | 439/322 |
| 4,941,846 | A * | 7/1990 | Guimond et al. | 439/578 |
| 5,161,993 | A * | 11/1992 | Leibfried, Jr. | 439/320 |
| 5,269,701 | A * | 12/1993 | Leibfried, Jr. | 439/578 |
| 5,888,095 | A * | 3/1999 | Hussaini | 439/584 |
| 6,186,455 | B1 * | 2/2001 | Hollingsworth et al. | 248/220.31 |
| 6,648,683 | B2 | 11/2003 | Youtey | |
| 6,705,884 | B1 * | 3/2004 | McCarthy | 439/394 |
| 7,425,153 | B1 | 9/2008 | Miller | |
| 7,445,488 | B2 * | 11/2008 | Feldmeier et al. | 439/394 |
| 2007/0093127 | A1 * | 4/2007 | Thomas et al. | 439/578 |
| 2010/0178799 | A1 * | 7/2010 | Lee et al. | 439/578 |

* cited by examiner

*Primary Examiner* — Gary Paumen

(57) ABSTRACT

A coaxial cable connector is provided having an inner contact configured to be terminated to a center conductor of a coaxial cable. A dielectric insert holds the inner contact. A shell holds the dielectric insert. The shell extends between a mating end and a cable end. The cable end includes a housing having an edge. The cable end is configured to be terminated to an end of the coaxial cable by pressing the edge into the end of the coaxial cable such that the housing is positioned radially inward of a jacket of the coaxial cable and the housing is in direct contact with a cable braid of the coaxial cable.

20 Claims, 4 Drawing Sheets

COAXIAL CABLE CONNECTOR

BACKGROUND OF THE INVENTION

The subject matter herein relates generally to coaxial cable connectors.

Coaxial cable connectors are commonly used to terminate coaxial cables and provide an electrical connection to a mating coaxial cable connector. The coaxial cable connector includes a metallic shell having a cylindrical sleeve. Centrally disposed within the sleeve is an inner contact. The inner contact is maintained in coaxial alignment with the sleeve by means of an optimized dielectric.

Past coaxial cable connector designs have been complex and have utilized costly manufacturing procedures. The individual parts are often assembled by several hand assembly steps to form the final connector. For example, conventional coaxial cables typically include a center conductor surrounded by an insulator. A conductive foil is disposed over the insulator and a cable braid surrounds the foil covered insulator. An outer insulative jacket surrounds the cable braid. In order to prepare the coaxial cable for termination, the outer jacket is stripped back exposing a portion of the cable braid, which is folded back over the jacket. A portion of the insulator extends outwardly from the jacket. The insulator is stripped to expose a portion of the center conductor extending outwardly from the insulator. Upon assembly of a coaxial cable connector to the coaxial cable, the inner contact of the connector is coupled to the center conductor of the coaxial cable, such as by a crimped or a soldered connection, and the outer shell of the connector is coupled to the conductive cable braid, such as by a crimped or soldered connection, at the end of the coaxial cable. The process of preparing an end of a coaxial cable for installation into a connector requires a skilled operator and is time consuming.

A need exists for a coaxial cable connector which can be terminated to an unprepared end of a coaxial cable with minimal assembly steps.

BRIEF DESCRIPTION OF THE INVENTION

In one embodiment, a coaxial cable connector is provided having an inner contact configured to be terminated to a center conductor of a coaxial cable. A dielectric insert holds the inner contact. A shell holds the dielectric insert. The shell extends between a mating end and a cable end. The cable end includes a housing having an edge. The cable end is configured to be terminated to an end of the coaxial cable by pressing the edge into the end of the coaxial cable such that the housing is positioned radially inward of a jacket of the coaxial cable and the housing is in direct contact with a cable braid of the coaxial cable. Optionally, the edge may be a knife edge configured to pierce the coaxial cable as the shell is pressed onto the coaxial cable.

Optionally, the housing may be positioned rearward of the dielectric insert and may have a smaller diameter than a diameter of the dielectric insert. The housing may be crimped to an end of the coaxial cable. The housing may extend axially along a connector axis and may include a first portion and a second portion with the second portion being provided at the edge and being thinner than the first portion. An outer surface of the housing may be stepped inward such that the housing is thinner at the edge. The housing may have an internal passageway defined by an inner surface. The inner surface may have a diameter approximately equal to a diameter of the cable braid. Optionally, the housing may be positioned between an insulator of the coaxial cable and the cable braid of the coaxial cable. Optionally, the housing may be positioned between the cable braid of the coaxial cable and the jacket of the coaxial cable.

In another embodiment, a coaxial cable connector is provided having an inner contact having a mating end and a cable end. The inner contact has a pin at the cable end. The pin is configured to be pressed into a coaxial cable to engage a center conductor of the coaxial cable. A dielectric insert holds the inner contact. A shell holds the dielectric insert. The shell extends between a mating end and a cable end. The cable end includes a housing having an edge. The cable end is configured to be terminated to an end of the coaxial cable by pressing the edge into the end of the coaxial cable such that the housing is positioned radially inward of a jacket of the coaxial cable and the housing is in direct contact with a cable braid of the coaxial cable.

DETAILED DESCRIPTION OF THE INVENTION

Figure 1:
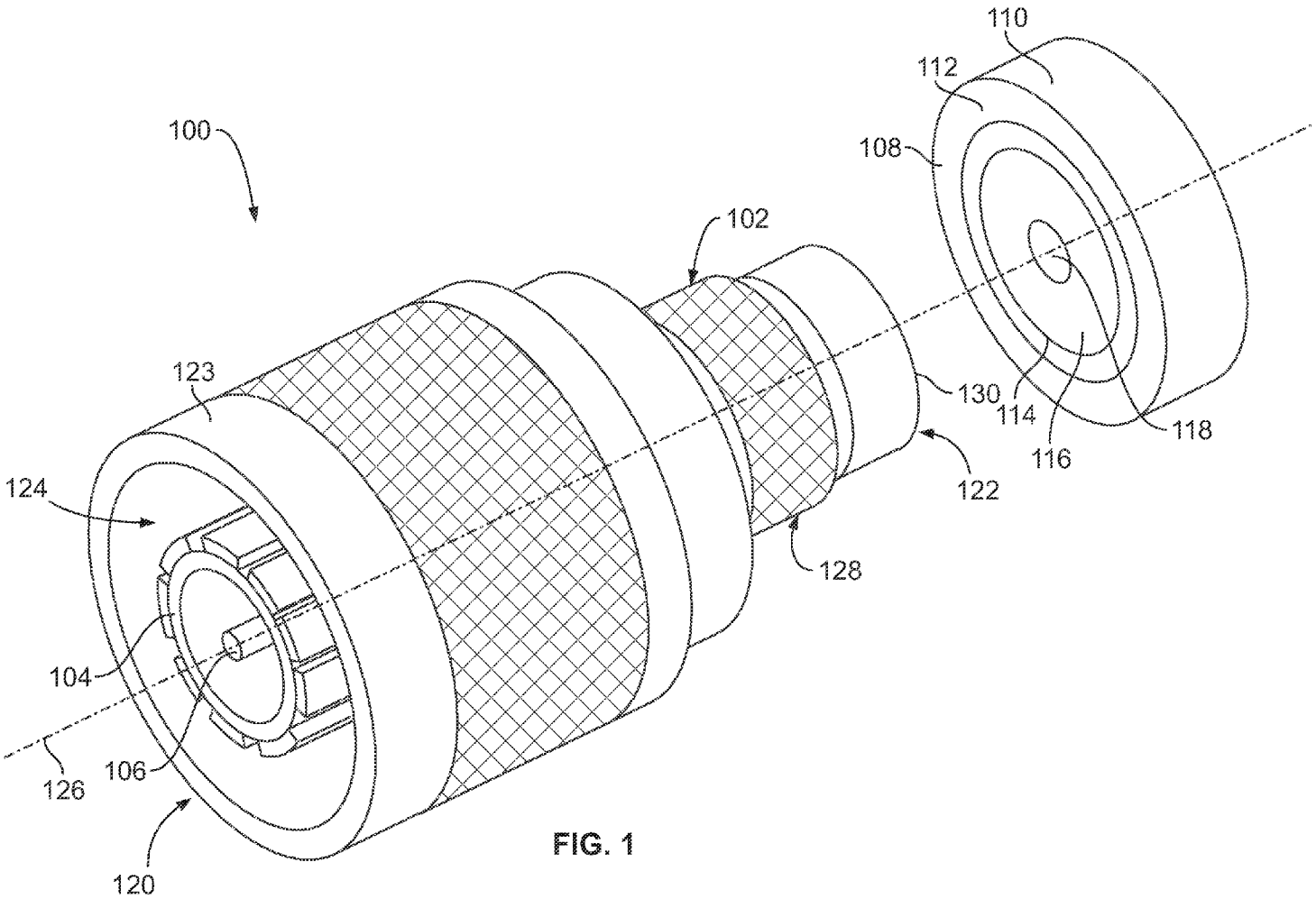
FIG. 1 is a front perspective view a coaxial cable connector formed in accordance with an exemplary embodiment.

FIG. 1 is a front perspective view a coaxial cable connector 100 formed in accordance with an exemplary embodiment. The coaxial cable connector 100 includes an outer metal shell 102, a dielectric insert 104 received and secured within the shell 102, and an inner contact 106 which is received within the dielectric insert 104. The coaxial cable connector 100 is configured to be pressed onto an end 108 of a coaxial cable 110 without needing to strip or otherwise prepare the coaxial cable 110. The coaxial cable 110 is cut to length, providing a flat, cut end 108.

The coaxial cable 110 has an outer jacket 112 surrounding a cable braid 114, which surrounds an insulator 116 and a center conductor 118. The insulator 116 electrically isolates the center conductor 118 from the cable braid 114. The cable braid 114 provides electrical shielding for the center conductor 118.

The shell 102 has a forwardly facing mating end 120 and a rearwardly facing cable end 122. The cable end 122 is configured to be terminated to the end 108 of the coaxial cable 110. For example, the cable end 122 may be crimped after being pressed into the coaxial cable 110.

The mating end 120 is configured for mating with a mating connector (not shown). The mating end 120 of the shell 102 may define an outer contact of the coaxial cable connector 100. The outer contact of the shell 102 is mated to a corresponding outer contact of the mating connector to create a grounded electrical path between the coaxial cable connector 100 and the mating connector.

Optionally, the coaxial cable connector 110 may include a locking collar 123 surrounding the outer contact of the shell 102. The locking collar 123 is used to secure the coaxial cable connector 100 to the mating connector. In the illustrated embodiment, the locking collar 123 is a quick connect type of locking collar using a bayonet type of connection to secure the mating connector within the coaxial cable connector 100. Other types of locking collars 123 may be used in alternative embodiments, such as threaded, screw type locking collars. In other embodiments, the coaxial cable connector 100 may be used without the locking collar 123. For example, the shell 102 may include threads for screw coupling the coaxial cable connector 100 to the mating connector. The locking collar 123 may be manufactured from a metal material and may be electrically connected to the outer contact to provide electrical shielding for the coaxial cable connector 100. Alternatively, the locking collar 123 may be manufactured from another material, including a dielectric material, such as a plastic material.

The shell 102 is manufactured from a metal material and provides electrical shielding around the inner contact 106. The shell 102 is generally cylindrical in shape and is spaced apart from the inner contact 106. The shell 102 has an internal passageway 124 extending along a connector axis 126. The shell 102, at the cable end 122, is configured to be electrically connected to the cable braid 114 of the coaxial cable 110.

In an exemplary embodiment, the shell 102 includes a housing 128 at the cable end 122. The housing 128 holds the dielectric insert 104. The housing 128 has an edge 130. The edge 130 is thin, like a knife edge, and is configured to pierce the end 108 of the coaxial cable 110 as the coaxial cable connector 100 is pressed onto the end 108 of the coaxial cable 110. For example, the edge 130 may pierce the end 108 of the coaxial cable 110 between the cable braid 114 and the insulator 116. The edge 130 may pierce the end 108 of the coaxial cable 110 between the cable braid 114 and the jacket 112. The edge 130 slices through the coaxial cable 110 as the coaxial cable connector 100 is pressed onto the end 108 of the coaxial cable 110. The housing 128 extends along and engages the cable braid 114 to electrically connect the shell 102 and the cable braid 114. Optionally, the entire length of the housing 128 may engage the cable braid 114. For example, the housing 128 may be pressed into the coaxial cable 110 until the dielectric insert 104 bottoms out against the insulator 116.

The dielectric insert 104 and inner contact 106 are held in the internal passageway 124. For example, the dielectric insert 104 is secured within the internal passageway 124 and the inner contact 106 is secured within the dielectric insert 104. The inner contact 106 extends along the connector axis 126. The inner contact 106 is positioned within the internal passageway 124 at the mating end 120 for mating with a corresponding mating contact (not shown) of the mating connector. The mating end 120 may have a different mating interface for mating with a different type of mating connector in an alternative embodiment.

Figure 2:
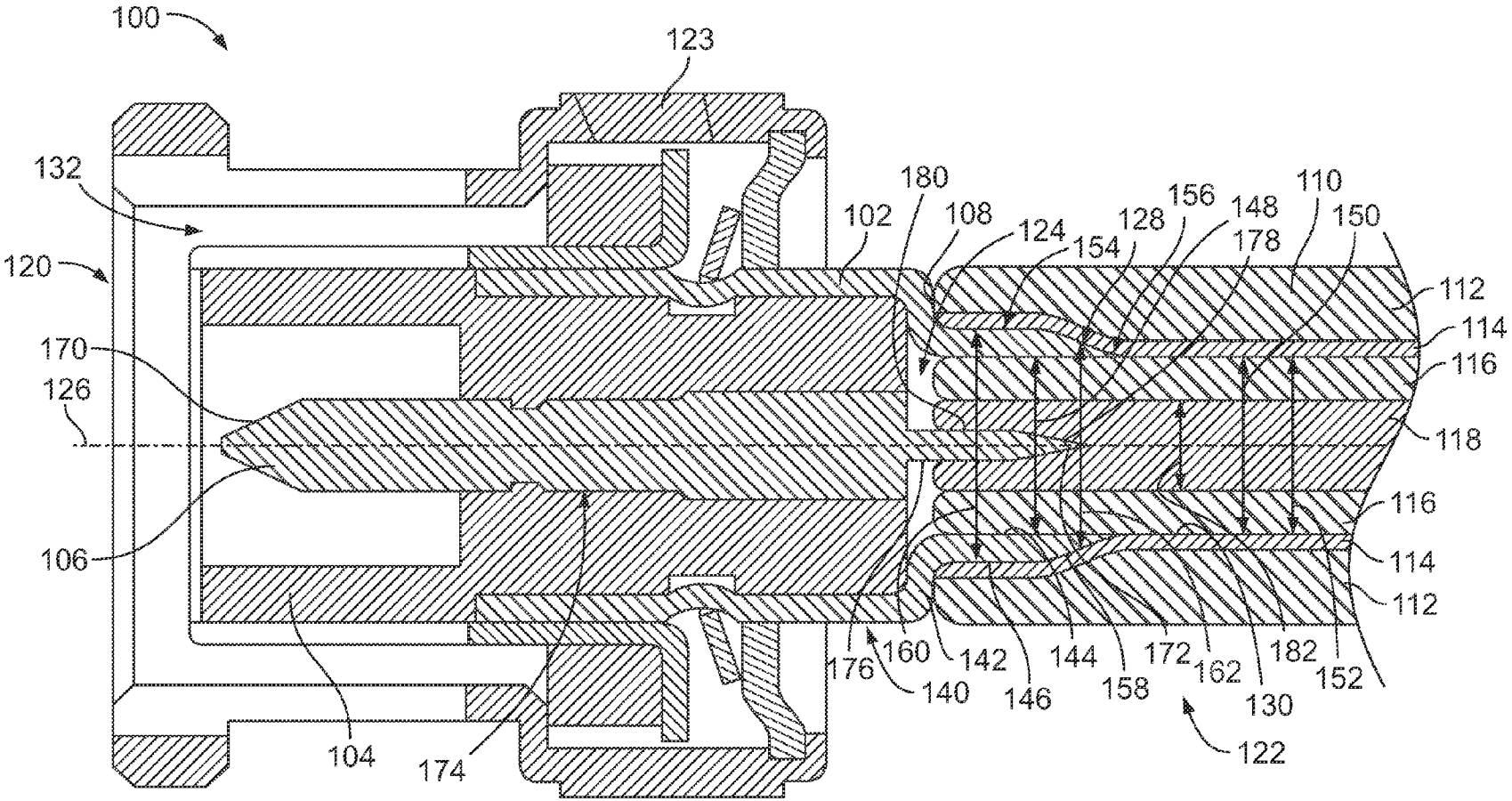
FIG. 2 is a cross-sectional view of the coaxial cable connector terminated to a coaxial cable.

FIG. 2 is a cross-sectional view of the coaxial cable connector 100 mated to the coaxial cable 110. During assembly, the inner contact 106 is received and secured within the dielectric insert 104. For example, the inner contact 106 may include shoulders that engage complementary shoulders of the dielectric insert 104. The dielectric insert 104 is received and secured within the shell 102. For example, detents or tabs of the shell 102 may be received within a groove or slots of the dielectric insert 104. The shell 102 defines an outer contact at the mating end that surrounds and provides electrical shielding for the inner contact 106. Optionally, the outer contact may be a separate piece from the housing 128, thus defining a two-piece shell, as in the illustrated embodiment. Alternatively, the outer contact at the mating end 120 and the housing 128 may be integral and form a one-piece body. The shell 102 is received and secured within the locking collar 123. A chamber 132 is defined between the shell 102 and the locking collar 123 that receives the mating connector. A portion of the locking collar 123 is movable with respect to the shell 102 to couple to the mating connector and secure the mating connector within the chamber 132. In an exemplary embodiment, the locking collar 123 is conductive and is electrically connected to the shell 102 and is configured to be electrically connected to the mating connector to electrically common the shell 102 and the mating connector.

The shell 102 includes a front portion 140. The dielectric insert 104 is received in the front portion 140. The front portion 140 is generally cylindrical and has an inner diameter that is substantially equal to an outer diameter of the dielectric insert 104. The housing 128 extends rearward from the front portion 140 to the edge 130 at a rear of the coaxial cable connector 100. A transition wall 142 extends between the front portion 140 and the housing 128. Optionally, the transition wall 142 may extend generally perpendicular to the connector axis 126 between the front portion 140 and the housing 128. Alternatively, the transition wall 142 may be angled between the front portion 140 and the housing 128. The dielectric insert 104 abuts against the transition wall 142 to stop rearward movement of the dielectric insert 104 within the internal passageway 124.

The housing 128 has a reduced diameter as compared to the front portion 140. The housing 128 has an inner surface 144 and an outer surface 146. The inner surface 144 defines the internal passageway 124 through the housing 128. Optionally, the inner surface 144 extends cylindrically along the connector axis 126. The internal passageway 124 in the housing 128 has an inner diameter 148. The inner diameter 148 is approximately equal to a cable braid diameter 150 of the cable braid 114. Optionally, the inner diameter 148 may be slightly smaller than the cable braid diameter 150 such that the housing 128 fits radially inside the cable braid 114. For example, the inner diameter 148 may be approximately equal to an insulator diameter 152 of the insulator 116. During assembly, when the coaxial cable connector 100 is pressed onto the end 108 of the coaxial cable 110, the edge 130 is received between the cable braid 114 and the insulator 116. The cable braid 114 is slightly displaced outward as the housing 128 is pressed between the cable braid 114 and the insulator 116. The outer surface 146 of the housing 128 engages and is electrically connected to the cable braid 114. Optionally, the coaxial cable 110 may include a foil between the insulator 116 and the cable braid 114. The housing 128 may pass between the foil and the insulator 116 and thus be electrically connected to the cable braid 114 through the foil. Alternatively, the housing 128 may pass between the foil and the cable braid 114.

The housing 128 includes a first portion 154 and a second portion 156. The first portion 154 is provided proximate to the transition wall 142 and is positioned forward of the second portion 156. The second portion 156 is provided proximate to the edge 130 and is positioned rearward of the first portion 154. The first portion 154 is thicker than the second portion 156. The first portion 154 is more rigid than the second portion 156. In an exemplary embodiment, the first portion 154 is configured to be crimped once the coaxial cable connector 100 is pressed onto the end 108 of the coaxial cable 110. The crimping presses the housing 128 inward against the insulator 116 of the coaxial cable 110 to secure the housing 128 to the coaxial cable 110. The second portion 156 is thinner than the first portion 154. The thin second portion 156 is configured to slice through the coaxial cable 110 during pressing of the coaxial cable connector 100 onto the coaxial cable 110.

In an exemplary embodiment, the outer surface 146 is stepped between the first and second portions 154, 156. The outer surface 146 includes a ramp 158 between the first and second portions 154, 156. The ramp 158 provides a smooth transition between the first and second portions 154, 156 to allow the housing 128 to be pressed into the coaxial cable 110.

The first portion 154 has a first outer diameter 160 and the second portion 156 has a second outer diameter 162 that is smaller than the first outer diameter 160. Optionally, the outer surface 146 may include more than one step. The outer surface 146 may include more than two portions that have different thicknesses. Optionally, the outer surface 146 may be knurled along the first portion 154 to resist removal of the coaxial cable connector 100 from the coaxial cable 110 after assembly. The outer surface 146 may be smooth along the second portion 156 to allow easy slicing through the coaxial cable 110 during assembly of the coaxial cable connector 100 to the coaxial cable 110.

The inner contact 106 extends between a mating end 170 and a cable end 172. The mating end 170 is configured to engage a corresponding mating contact of a mating connector. The cable end 172 is configured to be terminated to the center conductor 118 of the coaxial cable 110. The inner contact 106 is terminated to the center conductor 118 by pressing the inner contact 106 into the center conductor 118. The inner contact 106 includes a front contact 174 and a pin 176 extending rearward from the front contact 174. The front contact 174 defines the mating end 170. The front contact 174 extends through and is held in the dielectric insert 104. Optionally, the front contact 174 may extend forward from a front of the dielectric insert 104.

The pin 176 defines the cable end 172. The pin 176 is axially aligned with the housing 128 and extends along the connector axis 126 in the housing 128. The pin 176 is aligned with the center conductor 118 such that when the coaxial cable connector 100 is pressed onto the coaxial cable 110, the pin 176 pokes into the center conductor 118. The pin 176 includes a pin body 180 extending rearward from the front contact 174 to a tip 178. In an exemplary embodiment, the tip 178 is pointed. In another embodiment, the tip 178 is thinned to have a razor or cutting edge for cutting into the center conductor 118. The pin body 180 may be knurled. In the illustrated embodiment, the pin 176 has a smaller diameter than the front contact 174. The pin 176 has a smaller diameter than a diameter 182 of the center conductor 118. The pin 176 at least partially displaces the center conductor 118 (e.g. the different strands of the center conductor 118) pressing the center conductor 118 outward into the insulator 116. Such displacement may create an interference fit to help secure the coaxial cable connector 100 on the coaxial cable 110.

During assembly, the coaxial cable connector 100 is pressed onto the end 108 of the coaxial cable 110 until the end 108 of the coaxial cable 110 bottoms out against the transition wall 142 and/or the dielectric insert 104. For example, the jacket 112 may bottom out against the transition wall 142. The insulator 116 may bottom out against the dielectric insert 104. Optionally, a ferrule may be placed over the housing 128 and/or the coaxial cable 110 and crimped thereto to create a mechanical and/or electrical path between the housing 128 and the coaxial cable 110. Optionally, a dielectric boot or collar (not shown) may be secured over the ferrule and/or the end 108 of the coaxial cable 110 and the cable end 122 of the shell 102. The dielectric boot protects the end 108 from the environment, such as from catching on another item. Optionally, the dielectric boot may be used to secure the coaxial cable connector 100 to the coaxial cable 110. For example, an interference fit or other securing connection, such as bonding, may be created between the dielectric boot and the shell 102 and/or the jacket 112.

Figure 3:
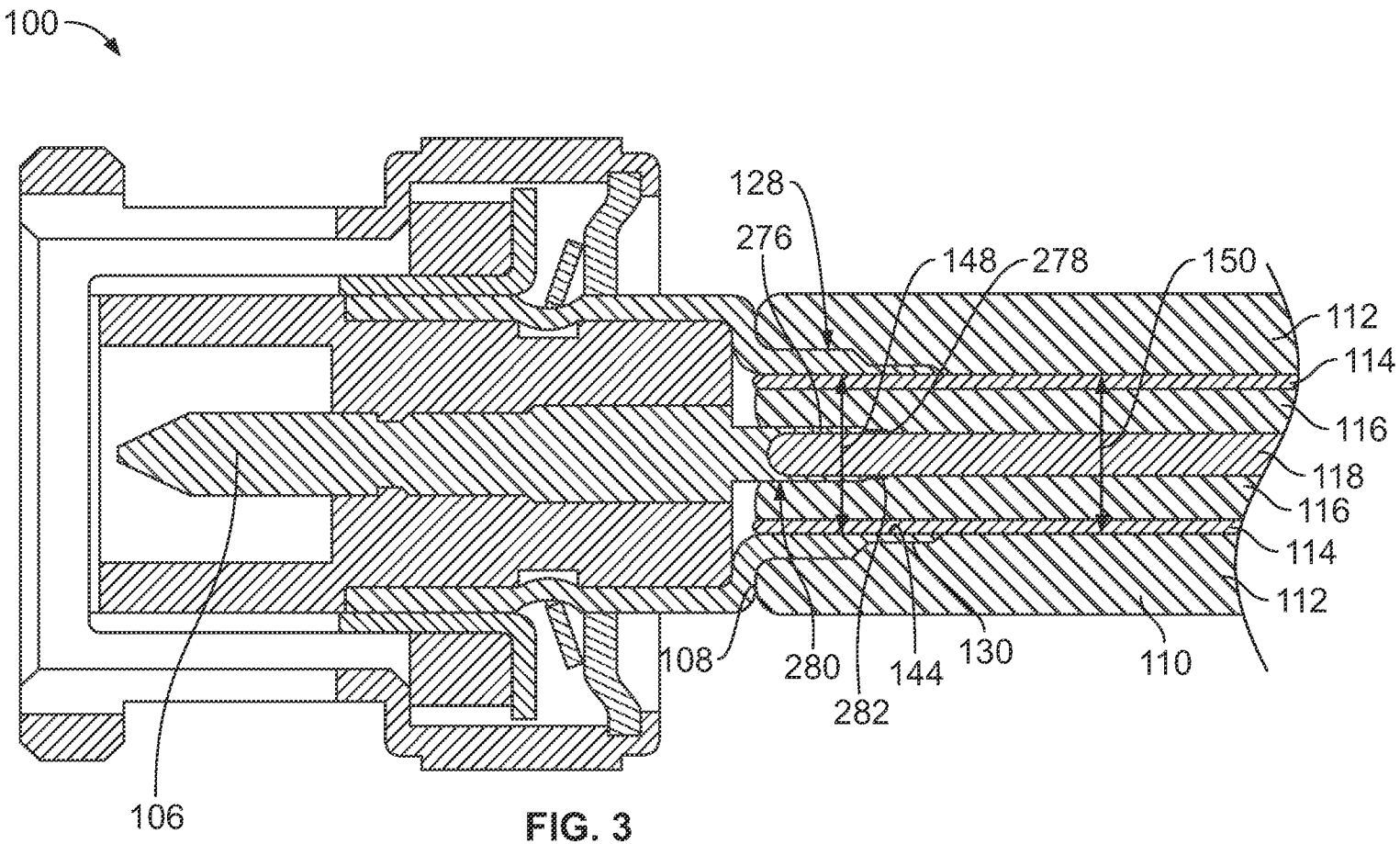
FIG. 3 is a cross-sectional view of the coaxial cable connector terminated to a coaxial cable.

FIG. 3 is a cross sectional view of the coaxial cable connector 100 attached to the coaxial cable 110 in a different manner. The housing 128 is positioned between the jacket 112 and the cable braid 114, as opposed to between the cable braid 114 and the insulator 116 as in the embodiment of FIG. 2. The inner diameter 148 may be slightly larger than the cable braid diameter 150 such that the housing 128 fits radially outside of the cable braid 114. For example, the inner diameter 148 may be approximately equal to an inner diameter of the jacket 112. During assembly, when the coaxial cable connector 100 is pressed onto the end 108 of the coaxial cable 110, the edge 130 is received between the cable braid 114 and the jacket 112. The jacket 112 is slightly displaced outward as the housing 128 is pressed between the cable braid 114 and the jacket 112. The inner surface 144 of the housing 128 engages and is electrically connected to the cable braid 114.

In the illustrated embodiment, the inner contact 106 has a different type of pin 276 than the pin 176 of the embodiment shown in FIG. 2. The pin 276 may be slotted. The pin 276 may include live or deflectable socket tines that engage the center conductor 118. The pin 276 has an open tip 278 with a central bore 280 open at a pin edge 282. The central bore is cylindrical in shape. The pin edge 282 is thinned and may have a knife-like edge for slicing through the coaxial cable 110. The pin edge 282 is pressed into the coaxial cable 110 between the center conductor 118 and the insulator 116. The pin edge 282 parts the center conductor 118 and the insulator 116. The center conductor 118 is received in the central bore 280 and engages the pin 276 to make electrical contact thereto. Optionally, the insulator 116 may be partially compressed as the coaxial cable connector 100 is pressed onto the coaxial cable 110, creating an interference fit between the coaxial cable connector 100 and the coaxial cable 110. Other types of pins are possible in alternative embodiments that may be pressed into engagement with the center conductor 118 and that do not require stripping or preparation of the coaxial cable 110.

Figure 4:
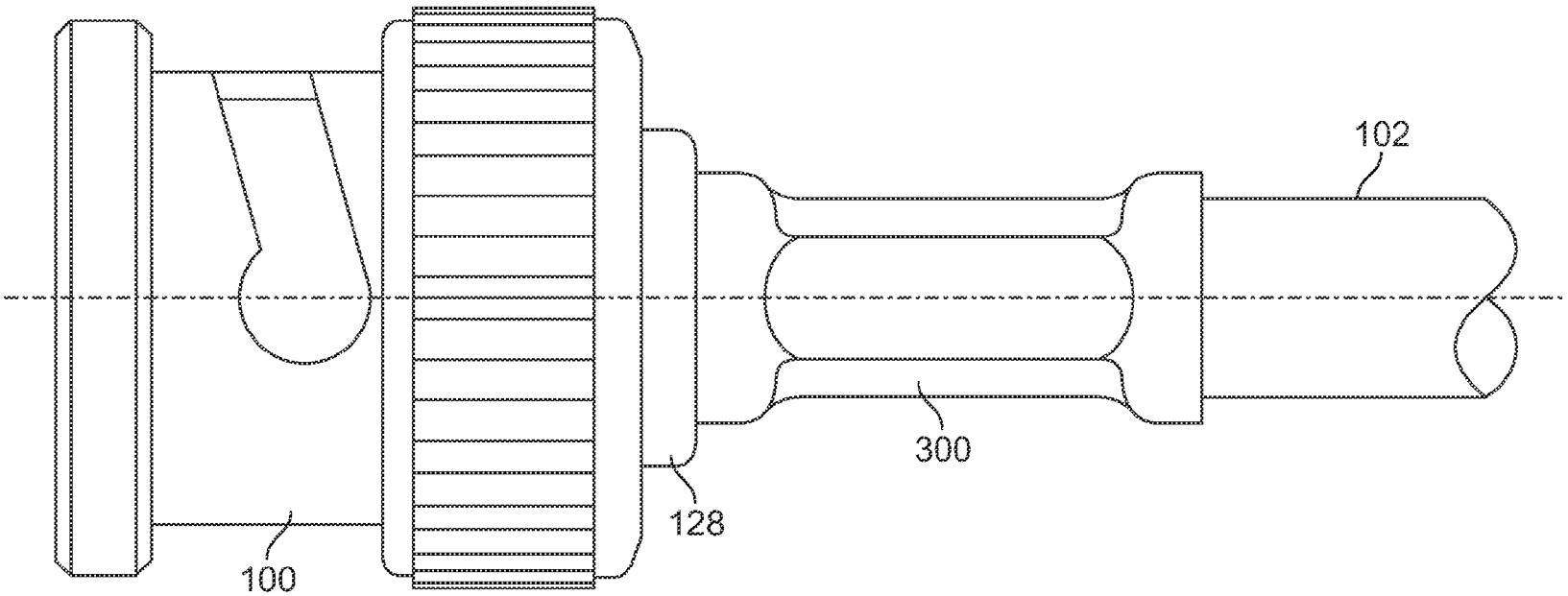
FIG. 4 is a side view of the coaxial cable connector terminated to a coaxial cable with a ferrule.

FIG. 4 is a side view of the coaxial cable connector 100 terminated to a coaxial cable 110 with a ferrule 300. The ferrule 300 is placed over the housing 128 and the coaxial cable 110 and crimped thereto to create a mechanical and/or electrical path between the housing 128 and the coaxial cable 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial cable connector configured to be attached to a generally flat, cut end of a coaxial cable, the coaxial cable connector comprising:

an inner contact configured to be terminated to an end of a center conductor of a coaxial cable;

a dielectric insert holding the inner contact; and a shell holding the dielectric insert, the shell extending between a mating end and a cable end, the cable end including a housing having an edge, the cable end being configured to be terminated to the flat, cut end of the coaxial cable by pressing the edge into the end of the coaxial cable such that the housing is positioned radially inward of an end of a jacket of the coaxial cable that is generally flush with the end of the center conductor, and the housing is in direct contact with a cable braid of the coaxial cable that is generally flush with the end of the center conductor and end of the jacket.

2. The coaxial cable connector of claim 1, wherein the edge is a knife edge configured to pierce the coaxial cable as the shell is pressed onto the coaxial cable.

3. The coaxial cable connector of claim 1, wherein the housing is positioned rearward of the dielectric insert, the housing having a smaller diameter than a diameter of the dielectric insert, the housing being configured to be crimped to the end of the coaxial cable.

4. The coaxial cable connector of claim 1, wherein the housing extends axially along a connector axis, the housing including a first portion and a second portion, the second portion being provided at the edge, the second portion being thinner than the first portion.

5. The coaxial cable connector of claim 1, wherein the housing extends axially along a connector axis, an outer surface of the housing being stepped inward such that the housing is thinner at the edge.

6. The coaxial cable connector of claim 1, wherein the housing has an internal passageway defined by an inner surface, the housing includes an outer surface, the inner surface having a diameter approximately equal to a diameter of the cable braid.

7. The coaxial cable connector of claim 1, wherein the housing is configured to be positioned between an insulator of the coaxial cable and the cable braid of the coaxial cable.

8. The coaxial cable connector of claim 1, wherein the housing is configured to be positioned between the cable braid of the coaxial cable and the jacket of the coaxial cable.

9. The coaxial cable connector of claim 1, further comprising a locking collar surrounding the shell, the locking collar being configured for locking engagement with a mating coaxial cable connector.

10. The coaxial cable connector of claim 1, wherein the housing and the shell are formed as a one-piece body extending axially along the inner contact to provide electrical shielding for the inner contact.

11. The coaxial cable connector of claim 1, wherein the inner contact includes a pin configured to be pressed into the center conductor of the coaxial cable.

12. A coaxial cable connector configured to be attached to a generally flat, cut end of a coaxial cable, the coaxial cable connector comprising:

an inner contact having a mating end and a cable end, the inner contact having a pin at the cable end, the pin being configured to be pressed into a coaxial cable to engage a center conductor of the coaxial cable;

a dielectric insert holding the inner contact; and a shell holding the dielectric insert, the shell extending between a mating end and a cable end, the cable end including a housing having an edge, the cable end being configured to be terminated to the flat, cut end of the coaxial cable by pressing the edge into the end of the coaxial cable such that the housing is positioned radially inward of an end of a jacket of the coaxial cable that is generally flush with the end of the center conductor, and the housing is in direct contact with a cable braid of the coaxial cable that is generally flush with the end of the center conductor and end of the jacket.

13. The coaxial cable connector of claim 12, wherein the pin includes a central bore, the pin extending to a pin edge, the pin being pressed into the coaxial cable such that the pin edge parts the center conductor and an insulator of the coaxial cable with the center conductor being received in the central bore.

14. The coaxial cable connector of claim 12, wherein the pin has a pointed tip being pressed into the center conductor of the coaxial cable.

15. The coaxial cable connector of claim 12, wherein the edge is a knife edge configured to pierce the coaxial cable as the shell is pressed onto the coaxial cable.

16. The coaxial cable connector of claim 12, wherein the housing is positioned rearward of the dielectric insert, the housing having a smaller diameter than a diameter of the dielectric insert, the housing being configured to be crimped to the end of the coaxial cable.

17. The coaxial cable connector of claim 12, wherein the housing extends axially along a connector axis, the housing including a first portion and a second portion, the second portion being provided at the edge, the second portion being thinner than the first portion.

18. The coaxial cable connector of claim 12, wherein the housing extends axially along a connector axis, an outer surface of the housing being stepped inward such that the housing is thinner at the edge.

19. The coaxial cable connector of claim 12, wherein the housing has an internal passageway defined by an inner surface, the housing includes an outer surface, the inner surface having a diameter approximately equal to a diameter of the cable braid.

20. The coaxial cable connector of claim 12, wherein the housing and the shell are formed as a one-piece body extending axially along the inner contact to provide electrical shielding for the inner contact.

* * * * *